US005400861A

United States Patent [19]

Sheirer

[11] Patent Number: 5,400,861

[45] Date of Patent: Mar. 28, 1995

[54] ROTATABLE CUTTING BIT ASSEMBLY

[75] Inventor: Daniel C. Sheirer, Bedford, Pa.

[73] Assignee: Kennametal, Inc., Latrobe, Pa.

[21] Appl. No.: 238,672

[22] Filed: May 5, 1994

[51] Int. Cl.[6] ..... E21B 35/00

[52] U.S. Cl. ..... 175/427

[58] Field of Search ..... 175/425–427, 175/354; 299/86, 91, 92, 93, 79

[56] References Cited

U.S. PATENT DOCUMENTS

| | | | |
|---|---|---|---|
| 3,519,091 | 7/1970 | Leibee et al. . | |
| 3,752,515 | 8/1973 | Oaks et al. . | |
| 3,763,941 | 10/1973 | Leibee et al. . | |
| 3,934,659 | 1/1976 | Tsiferov . | |
| 4,190,125 | 2/1980 | Emmerich et al. . | |
| 4,330,044 | 5/1982 | Orr et al. . | |
| 4,368,789 | 1/1983 | Orr et al. . | |
| 4,603,751 | 8/1986 | Erickson . | |
| 4,627,503 | 12/1986 | Horton . | |
| 4,678,238 | 7/1987 | Emmerich . | |
| 4,819,748 | 4/1989 | Truscott . | |
| 5,004,382 | 4/1991 | Yoshino . | |
| 5,071,195 | 10/1991 | Komotzki . | |
| 5,180,022 | 1/1993 | Brady . | |
| 5,195,805 | 3/1993 | Clapham . | |
| 5,261,499 | 11/1993 | Grubb | 175/427 |

FOREIGN PATENT DOCUMENTS 1044274 12/1978 Canada .

OTHER PUBLICATIONS

"Kennametal Mining Products"; Kennametal Inc., 1992.

*Primary Examiner*—Michael Powell Buiz
*Attorney, Agent, or Firm*—John J. Prizzi

[57] ABSTRACT

A roof drill bit assembly comprising a roof drill bit and a chuck. The roof bit contains a cavity which opens at the rearward end thereof. Upon assembling the bit and the chuck, the cavity receives the axially forward end of the chuck. A sealing member is between the roof drill bit and the chuck so as to provide a fluid-tight connection between the chuck and the roof bit.

26 Claims, 3 Drawing Sheets

ROTATABLE CUTTING BIT ASSEMBLY

BACKGROUND OF THE INVENTION

The invention pertains to a rotatable cutting bit assembly, including the cutting bit and the chuck therefor, wherein the cutting bit is useful for cutting through various earth strata. Specifically, the invention pertains to a wet roof drill bit assembly, which includes a roof drill bit and a chuck which connects the roof drill bit to the drill steel, for drilling bore holes in an underground mine.

The expansion of an underground mine, such as for example, a coal mine, requires digging a tunnel. Initially, this tunnel has an unsupported roof. In order to support and stabilize the roof in an established area of an underground tunnel, bore holes are drilled in the roof. The apparatus used to drill these holes comprises a drill with a long shaft, i.e., drill steel, attached to the drill. A roof drill bit is detachably mounted, either directly or through the use of a chuck, to the drill steel at the distal end thereof. The roof drill bit is then pressed against the roof, and drilling apparatus operated so as to drill a bore hole in the roof. The bore holes extend between two feet to greater than twenty feet into the roof. These bore holes are filled with resin and roof bolts are affixed within the bore holes. A roof support, such as roof panels, is then attached to the roof bolts.

In the past, there have been several styles of roof drill bits put to use to drill roof bolt bore holes. These styles include for wet drilling, i.e., where a coolant impinges upon the cutting inserts and in the area of drilling, a roof drill bit with a male shank and a roof drill bit which uses the body forging like that for a vacuum center roof bit, but has no side wall openings and presents fluid passages at the forward end thereof as well as an opening at the rear thereof.

Referring to the male shank type of roof drill bit, U.S. Pat. No. 4,190,125 to Emmerich et al., U.S. Pat. No. 4,819,748 to Truscott, and U.S. Pat. No. 5,180,022 to Brady illustrate various embodiments of a roof drill bit with a male shank. While the specific structure may vary, the male shank style of roof drill bit typically comprises a forward head portion which carries at least one cutting insert and a shank which depends rearwardly from the head portion. A drill steel has an opening at the forward end thereof that typically receives therein the male shank of the roof drill bit. A fastener then connects the roof drill bit to the drill steel at the male shank. In the case of the embodiments of FIGS. 1 and 6 of the Emmerich et al. patent, a retention pin and a spring retainer, respectively, connect the roof drill bit to the drill steel. In the case of the Truscott patent, a retention pin assembly appears to connect the roof drill bit to the drill steel. In view of the configuration of the male shank of the roof drill bit in the Brady patent, one or more retention pins appear to affix the roof drill bit to the drill steel.

By using a pin or other retention assembly that requires a hole be through the wall of the drill steel, there is communication between the cavity of the roof drill bit which contains coolant under pressure and the outside of the roof drill bit. During operation, this communication path provides for leakage of coolant in the form of a high pressure stream.

Another style of roof drill bit uses a bit body made from a forging like that for the center vacuum roof bit, except that the side openings are absent and fluid passages are in the forward end adjacent the cutting inserts. This style of roof bit also has a central cavity which has a rear opening which receives the forward end of a vacuum center style of chuck. A retention pin passes through the side of the roof bit body an into a transverse hole in the chuck. The chuck connects the drill bit to a hollow drill steel. The fluid passages are in communication with a source of pressurized coolant through the cavity, the longitudinal bore in the chuck and the bore of the drill steel. During operation, coolant escapes from the roof bit through the connection between the chuck and the roof bit.

In the past, a center vacuum roof drill bit has been used to drill roof bore holes, and U.S. Pat. No. 4,603,751 to Erickson depicts this style of roof drill bit. In this style of roof drill bit, there is a central cavity which opens at the rear of the bit as well as openings in the side wall of the drill bit which communicate with the cavity. The central cavity receives a chuck through the rear opening. The chuck connects the drill bit to a hollow drill steel. The openings and cavity communicate via a bore in the chuck and the drill steel with a source of vacuum which, in operation, causes the particles and other drilling debris to be sucked into the cavity through the openings and then out of the drilling area through the central bore of the drill steel.

In a roof bolt bore hole drilling operation, it is important that the cutting inserts of the roof drill bit receive sufficient coolant, which is typically water, to maintain a sufficiently low temperature. Because drilling generates great amounts of heat, it is necessary to cool the drill bit to avoid, or at least to reduce, the thermal degradation of the cutting insert material. This is true for most cutting insert materials including without limitation polycrystalline diamond composite and cemented tungsten carbide-cobalt materials. It is thus important in a wet drilling operation for a roof drill bit assembly to deliver sufficient coolant to the cutting insert in an efficient fashion.

In both the male shank style of roof drill bit and the modified center vacuum style of roof drill bit using a vacuum center chuck, the connection between the chuck and the roof bit provides for communication between the pressurized coolant and the outside of the roof bit. In other words, during the drilling operation, coolant escapes through this connections. Because the roof drill bit rotates at a high rate of revolution and the coolant is under pressure, the coolant that escapes typically does so in a high pressure stream so as to spray the operator with coolant. This makes the operator uncomfortable and makes for an unpleasant working environment. This also reduces the volume of coolant which the assembly delivers to the cutting inserts thereby reducing the efficiency of the roof drill bit assembly.

During the drilling operation, the operator can encounter a mud seam in the earth strata. Because of the great amount of mud, the passages which deliver the coolant directly to the cutting inserts can plug with the mud. When this occurs, the drilling operation must cease to allow the operator to clean out the passages. The fact that coolant leaks out of this assembly results in less volume of pressurized coolant entering the passages. This means that there is less coolant entering the passages to resist the plugging thereof. Furthermore, because the coolant follows the path of the least resistance, there is a greater tendency for the coolant to flow through the connection between the roof bit and the drill steel or chuck than through the fluid passages thereby ensuring that the passage will remain plugged with mud until manually unplugged by the operator.

Until now, there has not been a roof drill bit suitable for wet drilling which uses a body like that for a center vacuum roof bit. To provide a roof drill bit for wet drilling that uses a body forging like the body forging for the center vacuum bit would permit the manufacture of the same forging of the bit body for drilling applications using the center vacuum drill bit and the wet roof drill bit. This provides for manufacturing efficiencies not heretofore available.

SUMMARY OF THE INVENTION

It is an object of the invention to provide for an improved rotatable cutting bit assembly that is suitable for use in drilling bore holes.

It is another object of the invention to provide an improved rotatable cutting bit assembly that is used to drill bore holes in the roof of an underground mine shaft.

It is another object of the invention to provide an improved rotatable cutting bit assembly that is used to drill bore holes in the roof of an underground mine shaft wherein the assembly efficiently provides sufficient coolant to the cutting insert to prevent the cutting insert from reaching a temperature at which there is thermal degradation.

It is another object of the invention to provide an improved rotatable cutting bit assembly that is used to drill bore holes in the roof of an underground mine shaft wherein the assembly efficiently provides sufficient coolant to the cutting insert to prevent the plugging of the fluid passages with mud during the drilling operation.

It is another object of the invention to provide an improved rotatable rutting bit assembly that is used to drill bore holes in the roof of an underground mine shaft wherein the assembly efficiently provides sufficient coolant to the cutting insert without spraying the operator with coolant.

It is another object of the invention to provide an improved rotatable cutting bit assembly that is used to drill bore holes in the roof of an underground mine shaft wherein the forging for the roof bit body is the same as the forging for the body of a center vacuum roof bit.

In one form thereof, the invention is a rotatable cutting bit assembly which comprises a cutting bit which has an axially forward end and an axially rearward end, and at least one cutting insert at the axially forward end of the cutting bit. The cutting bit contains a cavity, defined by a cavity wall, wherein the cavity has an opening at the rearward end of the cutting bit. The cutting bit further contains at least one passage at the axially forward end thereof. The passage communicates with the cavity. The bit assembly also has a chuck with an axially forward end and an axially rearward end. Upon assembling the bit and the chuck, the cavity of the bit receives the axially forward end of the chuck. A sealing member is between the cavity wall and the chuck.

In another form of the invention, the invention is a chuck for assembly to a drill bit which has a rearwardly opening cavity defined by a cavity wall. The chuck comprises an axially forward end and an axially rearward end. The chuck has a central longitudinal bore therethrough and also carries a seal adjacent the axially forward end thereof. Upon assembling the bit and the chuck, the cavity of the bit receives the axially forward end of the chuck whereby the seal provides a fluid-tight seal between the cavity wall and the chuck.

In still another form, the invention is a drilling assembly for connection to a rotational driver and a source of pressurized fluid wherein the assembly comprises a drill bit which has a cutting element at the forward end thereof and contains a cavity opening at the rearward end thereof. The drill bit further contains a passage at the forward end thereof wherein the passage is in fluid communication with the cavity.

The drilling assembly also includes a chuck with opposite forward and rearward ends. The chuck has a central longitudinal bore in fluid communication with the cavity. The chuck carries a forward seal at the forward end thereof. The cavity of the drill bit receives the forward end of the chuck. A forward sealing member, which is between the chuck and the drill bit, provides a fluid-tight seal between the drill bit and the chuck. The chuck has a mediate external abutment which limits the distance one can insert the chuck into the cavity.

The drilling assembly further includes a drill rod that has opposite forward and rearward ends wherein the rearward end of the drill rod connects to the rotational driver. The drill rod contains a central longitudinal bore with an opening at the forward end thereof and the drill rod bore is in fluid communication with the source of pressurized fluid and the bore of the chuck. The opening in the drill rod bore receives the rearward end of the chuck. A rearward sealing member, which is between the drill rod and the chuck, provides a fluid-tight seal between the chuck and the drill rod. The abutment limits the distance one can insert the chuck into the drill rod bore.

BRIEF DESCRIPTION OF THE DRAWINGS

The following is a brief description of the drawings which form a part of this patent application.

DETAILED DESCRIPTION OF SPECIFIC EMBODIMENTS

Figure 1:
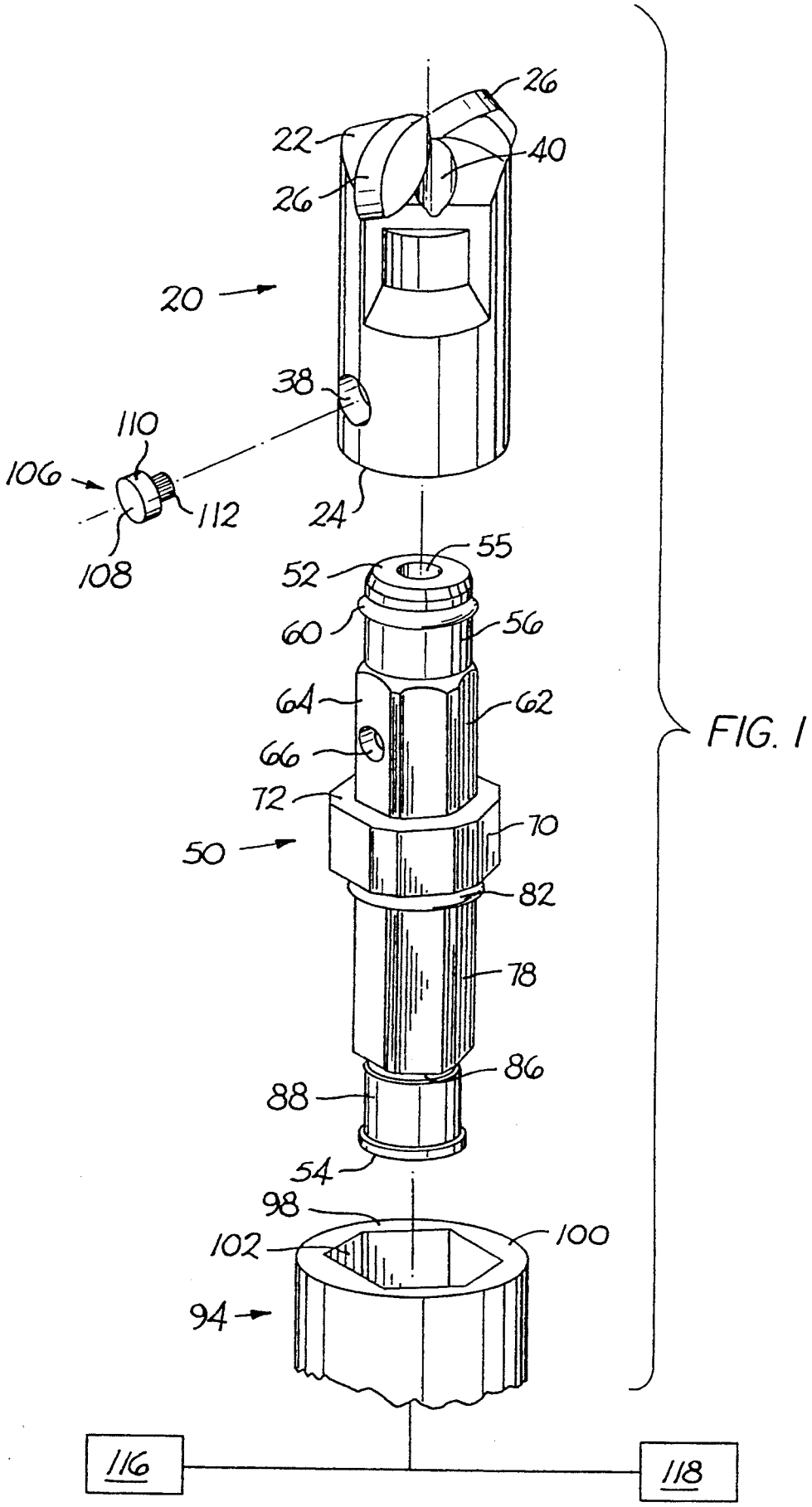
FIG. 1 is a perspective view of the roof bit, the chuck and a portion of the drill steel exploded apart.
Figure 2:
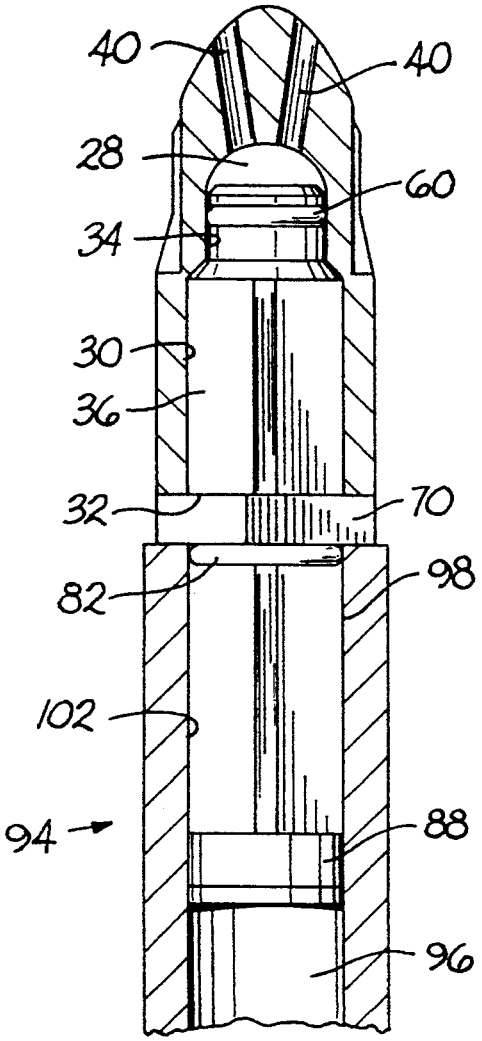
FIG. 2 is a side view of the assembly of the roof bit, the chuck and a portion of the drill steel wherein the roof bit and the drill steel are shown in cross-section.
Figure 3:
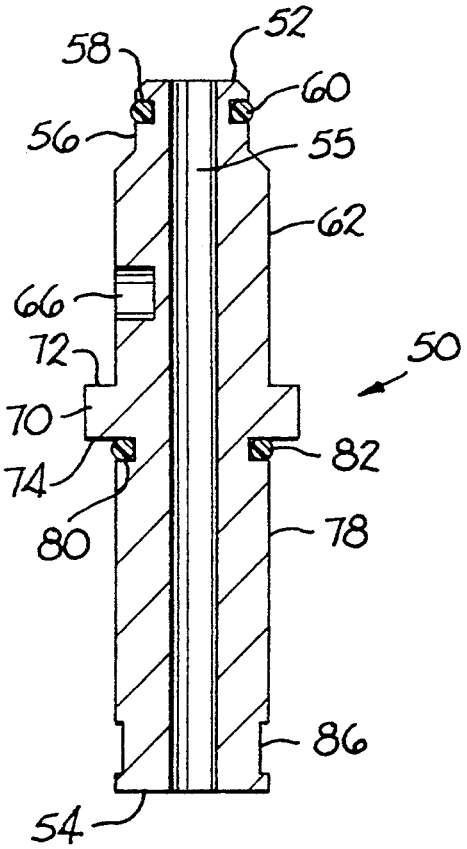
FIG. 3 is a cross-sectional side view of the chuck.

Referring to the drawings, and in particular to FIGS. 1 through 3, there is illustrated a rotatable cutting bit assembly which includes a cutting bit 20. The specific cutting bit 20 illustrated by the drawings is a roof bit and will be described as such hereinafter.

Roof bit 20 has an axially forward end 22 and an axially rearward end 24. FIG. 1 illustrates roof bit 20 with a pair of cutting inserts 26 at the forward end thereof. While the typical embodiment uses a pair of cutting inserts, there is no intention to limit the scope of the invention to any specific number or configuration of cutting inserts. U.S. patent application Ser. No. 07/935,956 filed Aug. 26, 1992 for a CUTTING BIT AND CUTTING INSERT to Shierer et al. and assigned to the assignee of the present application, discloses the preferred cutting inserts, i.e., polycrystalline diamond composite cutting inserts, and this patent application is hereby incorporated by reference herein. The reference to polycrystalline diamond composite inserts does not mean that other inserts are not suitable and should limit the scope of the invention. In fact, cemented tungsten carbide inserts are commonly put into use and this invention has application for roof drill bits which use any kind of material for the cutting inserts.

The roof bit 20 further contains a cavity 28. A cavity wall 30 defines the cavity 28. The cavity 28 has a rearward opening 32. The cavity wall 30 has a generally cylindrical portion 34 at the axially forward end thereof so as to define a generally cylindrical volume. The cavity wall 30 has a hexagonal portion 36 at the axially rearward end thereof so as to define a hexagonal, or non-cylindrical, volume.

The roof bit 20 has an aperture 38 through the side wall thereof. The roof bit 20 further contains a pair of fluid passages 40 in the forward end thereof. These passages 40 are in fluid communication with the cavity 28. These passages 40 have an orientation so that fluid, i.e., coolant such as water, passing therethrough impinges upon the cutting inserts 26.

The cutting bit assembly further includes a chuck generally designated as 50. Chuck 50 has an axially forward end 52 and an axially rearward end 54. The chuck 50 has a central longitudinal bore 55 extending through the entire length thereof.

The chuck 50 has a forward cylindrical surface portion 56 adjacent the forward end 52 thereof. Forward surface portion 56 contains an annular groove 58 which carries an O-ring seal 60. A forward hexagonal surface portion 62 is contiguous with and axially rearward of the forward cylindrical surface portion 56. Forward hexagonal surface portion 62 presents six generally flat surfaces which form a hexagon. One of the surfaces 64 contains an indentation 66 therein. The indentation 66 does not extend into the central bore 55 of the chuck 50.

The chuck 50 also has an abutment 70, in the form of a shoulder having an enlarged diameter, which is mediate between the axially forward end 52 and the axially rearward end 54 of the chuck 50. Abutment 70 presents a forwardly facing surface 72 and a rearwardly facing surface 74.

The chuck 50 further has a rearward hexagonal surface portion 78 axially rearward of the abutment 70. The rearward hexagonal surface portion 78 contains an annular groove 80 which carries an O-ring seal 82. A reduced diameter rearward cylindrical surface portion 86 is contiguous with and axially rearward of the rearward hexagonal surface portion 78. The reduced diameter rearward cylindrical surface portion 86 carries a resilient retainer ring 88.

FIGS. 1 and 2 illustrate the forward portion of a drill steel generally designated as 94. Drill steel 94 has a central longitudinal bore 96 which has an opening 98 at the forward end 100 thereof. The surface 102 of the bore at the forward end 100 is hexagonal in shape.

In regard to the assembly of the cutting bit assembly, the roof bit 20 receives the axially forward end 52 of the chuck 50. Referring to FIG. 2, the axially forward end 52 of the chuck protrudes into the cavity 28 to the extent the abutment 70 limits such protrusion. In this regard, the rearward end 24 of the roof bit 20 contacts the forwardly facing surface 72 of the abutment 70 so as to limit the extent one can insert the chuck 50 into the cavity 28.

When the chuck 50 is in position within the cavity 28, the O-ring seal 60 forms a fluid tight seal with the cylindrical portion 34 of the cavity wall 30 so that there is a fluid-tight seal between the chuck 50 and the roof bit 20. The result of this seal is that coolant which exits the bore 55 of the chuck 50 passes directly into the cavity and then into the passages 40. There is no leakage of coolant at the connection between the chuck and the roof bit. The forward hexagonal surface portion 62 of the chuck 50 registers with the hexagonal portion 36 of the cavity 28 so that there is a driving connection between the chuck 50 and the roof bit 20. A fastener 106 passes through the aperture 38 in the side wall of the roof bit 20 and into the indentation 66 in the chuck 50. In the embodiment of FIG. 1, the fastener 106 has a cylindrical head 108 with ridges 110 in the circumference thereof and a projecting stem 112. The stem 112 passes through the aperture 38 and into the indentation 66 to connect the chuck 50 and the roof bit 20. The ridges 110 engage the surface defining the aperture 38 so as to secure the fastener 106 in position.

The opening 98 in the drill steel 94 receives the axially rearward end 54 of the chuck 50. When the chuck 50 is in position within the opening 98, the O-ring seal 82 forms a fluid-tight seal with the wall of the opening 98 so that there is a fluid-tight seal between the chuck and the drill steel. The result of this seal is that coolant passing through the bore of the drill steel does not leak at the connection between the chuck and the drill steel. The rearward hexagonal surface portion 78 of the chuck registers with the hexagonal portion of the opening 98 so that there is a driving connection between the chuck 50 and the drill steel 94. The resilient retainer 88 expands to engage the cylindrical wall 104 of the drill steel to thereby retain the chuck to the drill steel.

In operation, the drill steel 94 connects to a driver 116 which rotates the drill steel. This, in turn, causes the chuck 50 and the roof drill 94 to rotate. The operator forces the roof bit against the roof in an underground mine shaft to drill the roof bolt hole. The coolant, which is typically water, passes through the central bore 96 of the drill steel 94 from a pressurized source of coolant 118. The coolant passes from the drill steel bore 96 to the bore 55 of the chuck 50 and then into the cavity 28 of the roof bit 20. The coolant then passes from the cavity 28 through the passages 40 in the roof bit 20 to impinge upon the cutting inserts 26. There is no leakage of coolant along the side of the roof bit assembly. Thus, during operation, the operator will not be drenched with a high pressure stream of coolant.

Figure 4:
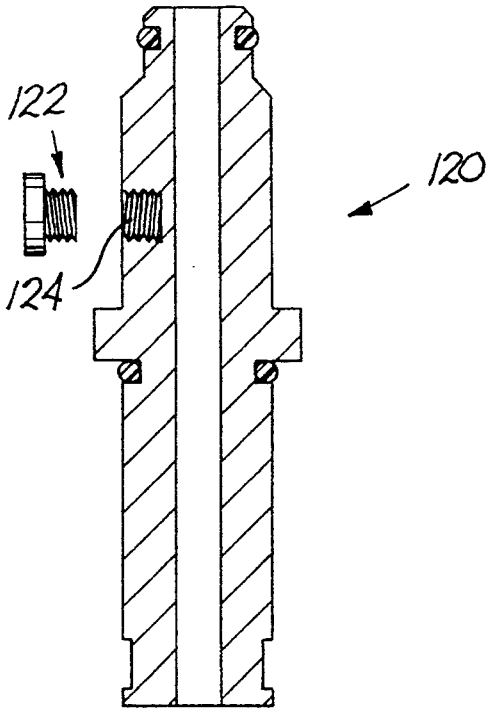
FIG. 4 is a cross-sectional side view of another embodiment of the chuck showing the threaded screw that the threaded hole receives so as to connect the roof bit to the chuck.

Referring to FIG. 4, there is shown a cross-sectional side view of a chuck 120 and a fastener 122. The chuck 120 is structurally the same as the chuck 50, except that rather than having an indentation, the chuck 120 has a threaded hole 124. The threaded hole 124 does not extend into the longitudinal bore of the chuck. The fastener 122 is a screw which threads into the hole 124. To connect the chuck to the roof drill, the screw passes through the aperture and into the threaded hole where once threaded, is secured therein so as to connect the chuck to the roof bit.

Figure 5:
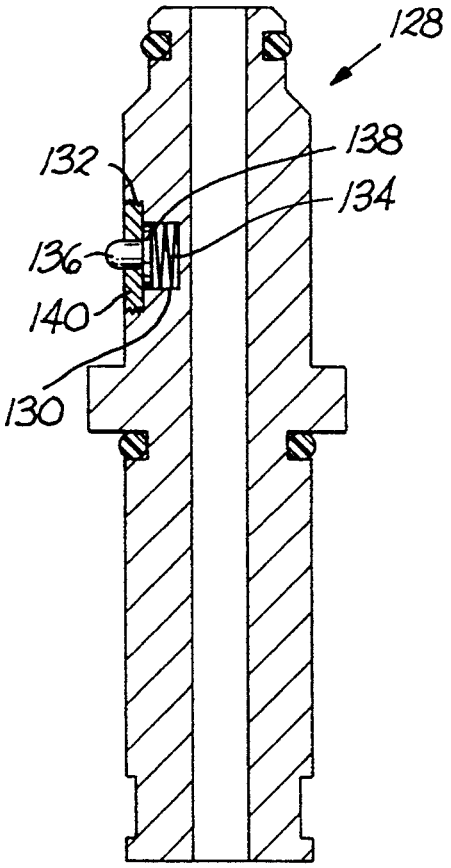
FIG. 5 is a cross-sectional side view of still another embodiment of the chuck showing a spring-biased plunger arrangement to connect the roof bit to the chuck.

Referring to FIG. 5, there is shown another embodiment of a chuck in cross-section. This chuck 128 has a blind hole therein which has two sections of different diameters; namely, a larger diameter section 130 and a smaller diameter section 132. A spring 134 is within the volume of the larger diameter section 132. A plunger is within the volume of the blind hole. The plunger has a projection 136 and a base 138. The base 138 of the plunger rests against the spring 134. A threaded washer 140, which has threads at the outer circumference thereof, threads into the smaller diameter section 132 of the blind hole until it retains the plunger within the blind hole. Upon the application of a force, the plunger can move radially inward against the bias of the spring. In the absence of any force, the spring moves the plunger axially outwardly to its extended position.

To connect the roof bit to the chuck 128, one inserts the chuck 128 into the rearward cavity of the roof bit. Upon this insertion, the plunger will move radially inwardly so that the chuck can move into the cavity. Upon the plunger encountering the aperture in the side wall of the roof bit, the plunger will move radially outwardly under the bias of the spring to engage the aperture and connect the roof bit to the chuck.

Figure 6:
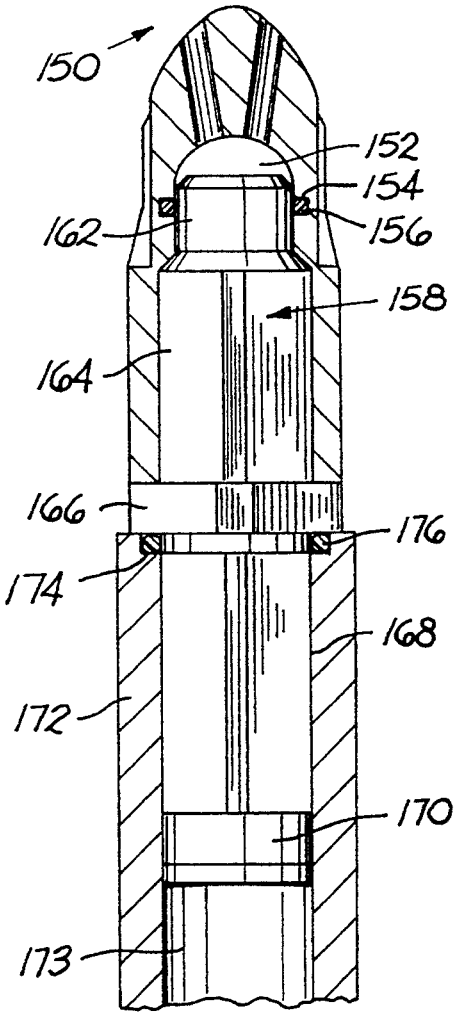
FIG. 6 is a cross-sectional side view of still another embodiment of the chuck showing the roof drill bit carrying an O-ring seal and the drill steel carrying an O-ring seal.

Referring to FIG. 6, there is illustrated another embodiment of the roof drill bit-chuck assembly. In this embodiment, the roof drill bit 150 is structurally similar to the roof drill bit 20, except that roof drill bit 150 contains an annular groove 154 in the wall of the cavity 152. The groove carries an O-ring seal 156. The chuck 158 includes a forward cylindrical portion 162 and a forward hexagonal portion 164. Chuck 158 also has a mediate abutment 166, and a rearward hexagonal portion 168 and a rearward reduced diameter portion which carries a retainer 170. the drill steel 172 has a bore 173. The wall that defines the bore contains a groove 174 which carries an O-ring seal 176 therein.

To assembly this embodiment, one inserts the forward end of the chuck 158 into cavity 152 of the roof drill bit 150 until the abutment impinges the rear end of the roof drill bit. At this point, the O-ring seal 156 forms a fluid-tight seal between the chuck and the roof drill bit. The rearward end of the chuck is within the bore 173 of the drill steel to a point where the forward end of the drill steel impinges the abutment 166. At this point, the O-ring 176 forms a fluid-tight seal between the chuck and the drill steel. The retainer 170 retains the chuck within the volume of the drill steel.

It can now be seen that applicant has provided an improved rotatable cutting bit assembly, such as for example, a roof drill bit assembly, that presents a number of advantages.

One advantage is that there is the direct and efficient passage of pressurized coolant from the source of coolant to the fluid passages. The presence of fluid-tight seals between the chuck and the roof drill bit and the chuck and the drill steel provide for this direct communication. By providing this direct and efficient communication, more coolant reaches the cutting inserts to better keep the temperature thereof within an acceptable range. Furthermore, because more coolant reaches the fluid passages and there is no leakage, the fluid pressure at the fluid passages is maintained at such a level so as to be better able to keep the fluid passages free from plugging due to mud, as well as unplug the fluid passages in the event they become plugged by mud.

Other specific embodiments of the invention will be apparent to those skilled in the art from a consideration of this specification or practice of the invention disclosed herein. It is intended that the specification and specific embodiments be considered as exemplary only, with the true scope and spirit of the invention being indicated by the following claims.

What is claimed is:

1. A rotatable cutting bit assembly comprising:

a cutting bit having an axially forward end and an axially rearward end, at least one cutting insert at the axially forward end of the cutting bit;

the cutting bit containing a cavity therein; the cavity having an opening at the rearward end of the cutting bit, a cavity wall defining the cavity;

the cutting bit further containing at least one passage at the axially forward end thereof, the passage communicating with the cavity;

a chuck having an axially forward end and an axially rearward end, and upon assembling the bit and the chuck, the axially forward end of the chuck being received within the cavity of the bit, a sealing member being between the chuck and the cavity wall.

2. The rotatable cutting bit assembly of claim 1 wherein the sealing member providing a fluid-tight seal between the chuck and the cavity.

3. The rotatable cutting bit assembly of claim 1 wherein the cavity wall containing a groove which carries the sealing member.

4. The rotatable cutting bit assembly of claim 1 wherein the chuck carrying the sealing member is adjacent the axially forward end thereof.

5. The rotatable cutting bit assembly of claim 1 wherein the cavity wall having a portion adjacent the axially forward end of the cutting bit being of a generally cylindrical shape, and the cavity wall having a portion adjacent the axially rearward end of the cutting bit being of a non-cylindrical shape.

6. The rotatable cutting bit assembly of claim 5 wherein the chuck having a forward cylindrical portion at the axially forward end thereof, the forward cylindrical portion of the chuck containing a groove therein, the groove carrying the seal; and upon assembling the cutting bit and the chuck, the seal engaging the generally cylindrical portion of the cavity wall thereby providing a fluid-tight seal between the cylindrical portion of the cavity wall and the forward cylindrical portion of the chuck.

7. The rotatable cutting bit assembly of claim 6 wherein the chuck further having a forward non-cylindrical portion axially rearward of the forward cylindrical portion, the configuration of the forward non-cylindrical portion corresponding to the configuration of the non-cylindrical portion of the cavity wall; and upon assembling the cutting bit and the chuck, there being a driving connection between the cutting bit and the chuck.

8. The rotatable cutting bit assembly of claim 7 wherein the forward non-cylindrical portion of the chuck containing an indentation, the cutting bit containing an aperture passing through the non-cylindrical portion of the cavity wall; and upon assembling the cutting bit and the chuck, a fastener passing through the aperture in the cutting bit and into the indentation thereby securing the cutting bit to the chuck.

9. The rotatable cutting bit assembly of claim 1 further including:

a drill rod having an axially forward end, the drill rod having a central longitudinal bore, the bore having a non-cylindrical portion and a cylindrical portion, the drill rod bore communicating with a source of fluid;

the chuck having a central longitudinal bore therethrough; and upon assembling the cutting bit and the chuck, the passage of the cutting bit being in communication with the source of fluid via the cavity of the cutting bit and the central longitudinal bore of the chuck and the drill rod bore.

10. The rotatable cutting bit assembly of claim 9 wherein the chuck having a non-cylindrical rearward portion and a cylindrical rearward portion, an enlarged diameter shoulder separating the forward cylindrical portion and the rearward non-cylindrical portion of the chuck; and upon assembling the chuck and the drill rod, the non-cylindrical portion of the drill rod bore registering with the rearward non-cylindrical portion of the chuck thereby forming a driving connection between the drill rod and the chuck.

11. The rotatable cutting bit assembly of claim 10 wherein the rearward non-cylindrical portion of the chuck containing a groove carrying a rearward sealing member; and upon assembling the chuck and the drill rod, the rearward sealing member engaging the cylindrical portion of the drill rod bore thereby providing a fluid-tight seal between the chuck and the wall defining the drill rod bore.

12. The rotatable cutting bit assembly of claim 11 wherein the chuck carrying a retainer adjacent the rearward end thereof; and upon assembling the drill rod and the chuck, the retainer engaging the wall defining the cylindrical portion of drill rod bore thereby securing the chuck to the drill rod.

13. The rotatable cutting bit of claim 1 wherein the cutting bit contains an opening in the cavity wall thereof communicating with the cavity, and the chuck having a biased plunger, the plunger being movable between an extended position in which the plunger engages the opening in the cavity wall upon the assembly of the chuck and the bit and a retracted position in which the plunger does not engage the opening within the cavity wall.

14. A chuck for assembly to a drill bit having a rearwardly opening cavity defined by a cavity wall, the chuck comprising:

an axially forward end and an axially rearward end, the chuck having a central longitudinal bore therethrough, the chuck carrying a seal adjacent the axially forward end thereof; and upon assembling the bit and the chuck, the axially forward end of the chuck being received within the rearwardly opening cavity of the bit whereby the seal providing a fluid-tight seal between the cavity wall and the chuck.

15. The chuck of claim 14 including a forward cylindrical portion at the axially forward end thereof, the forward cylindrical portion having a groove therein, the groove carrying the seal; and upon assembling the drill bit and the chuck, the seal providing a fluid-tight seal between the cylindrical portion of the chuck and the adjacent portion of the cavity wall.

16. The chuck of claim 15 including a forward non-cylindrical portion axially rearward of the forward cylindrical portion, and the configuration of the forward non-cylindrical portion corresponding to the configuration of the adjacent portion of the cavity wall; and upon assembling the drill bit and the chuck, there is a driving connection between the chuck and the drill bit.

17. The chuck of claim 16 wherein the forward non-cylindrical portion of the chuck contains an indentation; and upon assembling the drill bit and the chuck, the indentation receiving a fastener thereby connecting the drill bit to the chuck.

18. The chuck of claim 14 further including a central longitudinal bore.

19. A drilling assembly for connection to a rotational driver and a source of pressurized fluid, the assembly comprising:

a drill bit having a cutting element at the forward end thereof and containing a cavity opening at the rearward end thereof, the drill bit further containing a passage at the forward end thereof, the passage being in fluid communication with the cavity;

a chuck having opposite forward and rearward ends, the chuck having a central longitudinal bore in fluid communication with the cavity, the chuck carrying a forward seal at the forward end thereof, the forward end of the chuck being received within the cavity of the drill bit, a forward sealing member being between the chuck and the drill bit so that the forward seal providing a fluid-tight seal between the drill bit and the chuck, the chuck having a mediate external abutment limiting the distance the chuck can be inserted into the cavity; and a drill rod having opposite forward and rearward ends, the rearward end of the drill rod being connected to the rotational driver, the drill rod containing a central longitudinal bore with an opening at the forward end thereof, the drill rod bore being in fluid communication with the source of pressurized fluid, the drill rod bore being in fluid communication with the bore of the chuck, the opening in the drill rod bore receiving the rearward end of the chuck, a rearward sealing member being between the drill rod and the chuck so that the rear sealing member providing a fluid-tight seal between the chuck and the drill rod, and the abutment limiting the distance the chuck can be inserted into the drill rod bore.

20. The drilling assembly of claim 19 wherein the chuck carrying the forward sealing member.

21. The drilling assembly of claim 19 wherein the drill bit carrying the forward sealing member.

22. The drilling assembly of claim 19 wherein the drill rod carrying the rearward sealing member.

23. The drilling assembly of claim 19 wherein there being a driving connection between the drill bit and the chuck, and there being a driving connection between the chuck and the drill rod.

24. The drilling assembly of claim 19 wherein the chuck carrying a retainer, and the retainer engaging the bore of the drill rod thereby retaining the chuck to the drill rod.

25. The drilling assembly of claim 19 wherein the passage directs pressurized fluid toward the cutting insert during the drilling operation.

26. The drilling assembly of claim 19 wherein the drill bit containing a plurality of cutting inserts, and the drill bit containing a plurality of passages.

* * * * *